United States Patent [19]

Theeten

[11] Patent Number: 4,779,365

[45] Date of Patent: Oct. 25, 1988

[54] IRONING BOARD OR SUPPORT WITH ACCESSORY IRONING SURFACES

[76] Inventor: Bernard Theeten, 4 résidence Charles Gounod, 59118 Wambrechies, France

[21] Appl. No.: 110,700

[22] PCT Filed: Feb. 10, 1987

[86] PCT No.: PCT/FR87/00037

§ 371 Date: Sep. 23, 1987

§ 102(e) Date: Sep. 23, 1987

[87] PCT Pub. No.: WO87/05060

PCT Pub. Date: Aug. 27, 1987

[30] Foreign Application Priority Data

Feb. 12, 1986 [FR] France ..... 86 02199

[51] Int. Cl.[4] ..... D06F 81/00; D06F 81/12

[52] U.S. Cl. ..... 38/135; 38/136; 108/59; 108/90; D32/66

[58] Field of Search ..... 38/135, 136, 112; 108/59, 28, 90, 92, 97; D32/66

[56] References Cited

U.S. PATENT DOCUMENTS

| | | | |
|---|---|---|---|
| D. 28,202 | 1/1898 | Dana | D32/66 |
| 181,813 | 9/1876 | Bagley | 38/135 X |
| 746,518 | 12/1903 | Jennings | 38/135 |
| 868,500 | 10/1907 | Springer | 108/92 |
| 980,762 | 1/1911 | Cooper | 108/97 |
| 1,206,628 | 11/1916 | Webster | 38/135 X |
| 1,443,917 | 1/1923 | Herman . | |
| 2,650,442 | 9/1953 | Johnson . | |
| 2,699,617 | 1/1955 | Hyams . | |
| 2,700,836 | 2/1955 | Bugg, Jr. . | |
| 2,888,760 | 6/1959 | Shaffer . | |
| 4,612,863 | 9/1986 | Vonhausen et al. | 108/97 X |

FOREIGN PATENT DOCUMENTS

| | | |
|---|---|---|
| 1146635 | 11/1957 | France . |
| 3895 | of 1909 | United Kingdom . |

*Primary Examiner*—Andrew M. Falik

*Attorney, Agent, or Firm*—Kerkam, Stowell, Kondracki & Clarke

[57] ABSTRACT

An ironing support or board structure has two parallel ironing surfaces formed of boards connected by spacer elements of small height. One of the ironing surfaces is formed by a single board, referred to as the main board. The other ironing surfaces are formed by two separate accessory boards which overhang or overlap the main board. The spacer elements which connect the accessory boards to the main board are associated with the main board at opposite ends of the main board. This results in free parts or free ends of each accessory board extending towards the other accessory board.

9 Claims, 1 Drawing Sheet

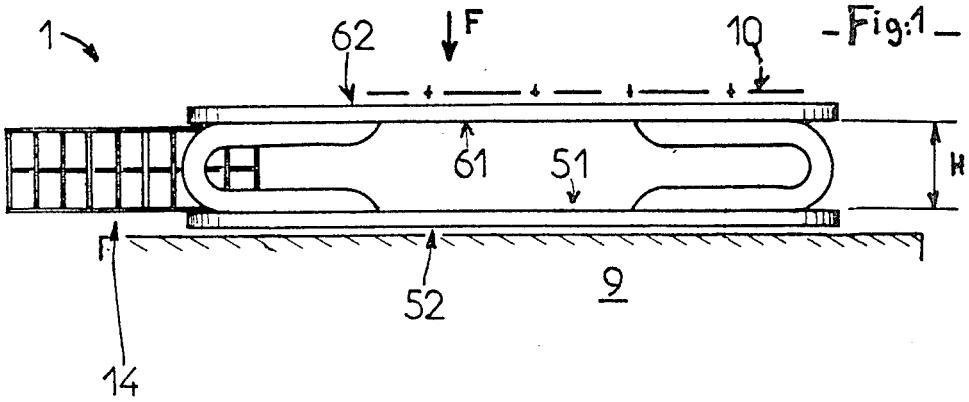
-Fig:1-
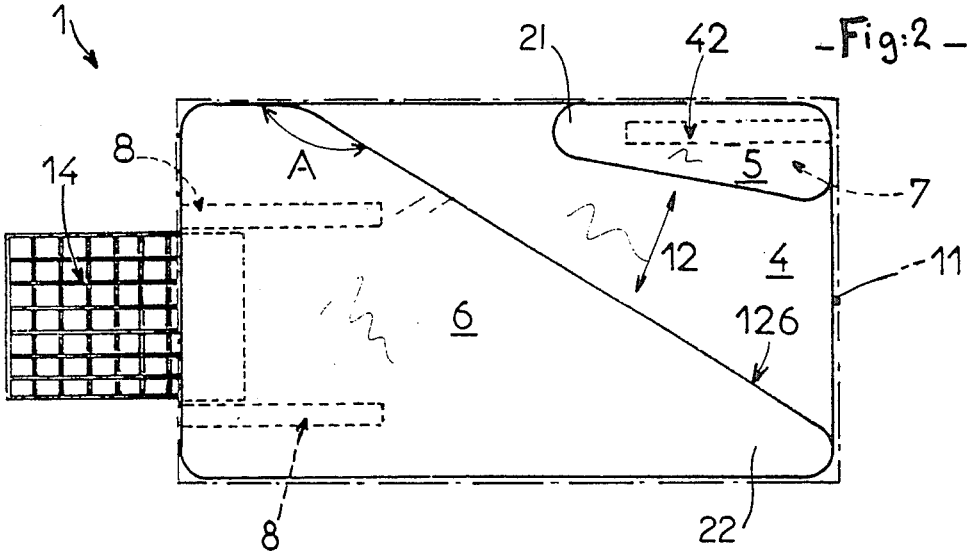
-Fig:2-
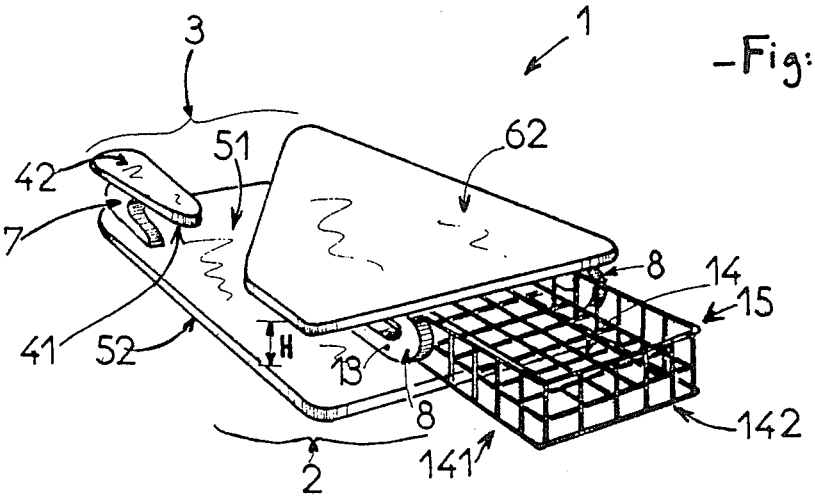
-Fig:3-

IRONING BOARD OR SUPPORT WITH ACCESSORY IRONING SURFACES

BACKGROUND OF THE INVENTION

The invention relates to an ironing board or support.

In this field, an ironing support is already known (FR-A-1 146 635 and U.S. Pat. No. 2,888,760) having two parallel work surfaces, formed of two boards connected together in the vicinity of one of their ends by spacer elements bearing on opposing faces of said boards.

After receiving a covering of any known type, the face of one of the boards which is turned outwardly forms the ironing surface, and a face of the other board forms a surface bearing on the stable element such as a table.

Of course, for ironing clothes of varying dimensions and cuts, each board has a substantially different shape.

In particular, so as to have a maximum ironing surface, the largest of the two boards has a substantially rectangular shape but is rounded at its free end.

The other board has its free end which either forms a wide circular board connected to the rest of the board by wide necks (FR-A-1 146 635) or is split longitudinally into two parts which end in rounded portions and are connected together by a wide neck (U.S. Pat. No. 2,888,760).

Although, at first sight, the periphery of each of the boards of these devices provides an ironing surface with sufficiently variable contours to cope with the diversity of shapes of clothes to be ironed, the concave parts formed by the necks make it very difficult to cover the working surfaces of the boards without providing the covering clips which will form creases in the clothes to be ironed.

Furthermore, since the elements spacing the two boards apart are only disposed in the vicinity of one of the ends of the support, over the majority of their length the two boards are cantilevered.

At the time of using the table and particularly during ironing on its large board, the forces to which it is then subjected cause the upper board to bend.

The resulting instability is obviously a hindrance when ironing.

Other ironing supports are known (GB-A-3895, U.S. Pat. No. 2,699,617) having two parallel working surfaces formed by a main board having a large ironing surface and a very small board forming a sleeve board which is fixed at one of its ends to the main board through a spacer element.

When using the main board, and considering the smallness of the sleeve board, the instability is even greater.

To overcome this drawback, one of these supports (GB-A-3895) has its main board which is provided, on the face carrying the sleeve board, with members in which feet may be removably fixed for allowing the main board to bear on the stable element not only via the sleeve board and its spacer element but also beyond the sleeve board and particularly on the side opposite the spacer element.

Although these feet give good stability, they of course complicate the manufacture of the board and its use considering the fitting/removal operations necessary at each reversal.

Furthermore, since they have to be removed for using the sleeve board, the feet risk being lost.

SUMMARY OF THE INVENTION

A result which the invention aims at obtaining is an ironing support which overcomes the above mentioned drawbacks.

For this, the invention provides a support of the above mentioned type particularly characterized in that:

one of the ironing surfaces is formed by a single so called main board, whereas the other ironing surface is formed by two separate accessory boards overhanging the main board and, instead of being all disposed at the same end of the support, the spacer elements connecting respectively the accessory boards to the main board are associated with the main board at opposite ends thereof, the free parts of the accessory boards being thus turned towards one another.

BRIEF DESCRIPTION OF THE DRAWINGS

The invention will be better understood from the following description given by way of non limitative example with reference to the accompanying drawings which show schematically:

FIG. 1 shows a side view of the ironing board

FIG. 2 shows a view from arrow F of FIG. 1, and

FIG. 3 shows the ironing support in perspective.

DETAILED DESCRIPTION

Referring to the drawings it can be seen that the ironing support 1 has in a way known per se two parallel ironing surfaces 2, 3 formed of boards 4, 5, 6 of appreciably different shapes and dimensions connected together by spacer elements 7, 8 of small height H bearing on the opposing faces 41, 51, 61 of the boards 4, 5, 6 forming the parallel ironing surfaces.

On their faces 42, 52, 62 situated on the same side as the ironing surfaces 2, 3 and thus called external faces, boards 4, 5, 6 are provided with a covering (not shown) of any known type, for example an insulating cover.

By simply turning over support 1 different ironing surfaces may be used corresponding to the diversity of shapes of clothes 10 to be ironed.

This is why the boards have differences from the geometrical point of view.

Of course support 1 rests by one of its ironing surfaces 2, 3, then forming a bearing surface, on a stable element 9 of suitable height such as a table.

In acordance with the invention:

on the one hand one (2) of the ironing surfaces is formed by a single so called main board 4, whereas the other ironing surface (3) is formed by two separate accessory boards 5, 6 overhanging the main board 4 and, on the other hand, instead of being all disposed at the same end of the support, the spacer elements 7, 8 connecting the accessory boards 5, 6 respectively to the main board 4 are associated with the main board 4 at opposite ends thereof. Accordingly, the free parts 21, 22 of the accessory boards (i.e., parts opposite the connection of braces or spacers 7, 8 are turned towards one another.

Thus, during ironing on the main board, it is supported by elements 7, 8 at its two ends, which prevents it from bending.

The accessory boards 5, 6 have substantially different dimensions, one (5) comparable to those of a sleeve board and the other appreciably larger and particularly of a width substantially equal to that of the main board with which it is associated by at least two spacer elements 8 spaced so as to offer, with the spacer element 7 of the sleeve board 5, the widest possible support polygon on the stable element 9.

Since the main board has the substantially rectangular shape, the spacer elements 7, 8 are then disposed at the periphery of this board for example in three of the four corners of said main board which confer thereon a great stability.

To have an optimum surface without increasing the size of support 1, in projection parallel to the plane of the main board, the accessory boards 5, 6 are inscribed inside the contour of the outer boundaries of the main board and preferably mate with its contours along at least two of their edges and are thus in the form of an imaginary rectangular panel 11 split into two parts 5, 6 separated from one another by a certain space 12 useful for engaging the clothes to be ironed 10 over the free end of the accessory boards 5, 6.

Thus, in this preferred embodiment, the accessory boards have substantially the shape of right angled triangles whose hypotenuses face each other.

The edge 126 of the largest accessory board defining space 12 extends substantially along the diagonal of the imaginary rectangle 11.

Preferably, on the same side as the spacer elements 8 of the corresponding board, this edge 126 does not join up with the corner of the imaginary rectangle 11 but with the longitudinal side thereof so as to confer on the large accessory board a right angled trapezium shape providing on the contour of the board an obtuse angle A suitable for ironing certain clothes 10 and particularly neck openings and shoulders.

Preferably, the spacer elements 7, 8 have a fixed height but, of course, they may also:

have an adjustable height and to this end include means (not shown) for adjusting their height, or be foldable or removable.

In all cases, the spacer elements 7, 8 are designed so as to resist any appreciable deformation under the forces received during ironing and to limit as little as possible the possibilities of fitting clothes to be ironed 10 on at least some of the accessory boards.

Provided that elements 7, 8 satisfy the conditions mentioned above, any shape is suitable but preferably the spacers will have the shape of an elongate "C".

In the gap of height H formed between the main board 4 and the accessory boards 5 and 6, accessory elements may obviously be housed.

For example, a caisson and pipes may be positioned there and/or means for connection to a unit for removing the vapor due to ironing and collected through at least one of the boards 4, 5, 6.

In this case, the board concerned at least is made from a permeable material and, for example, made from an expanded metal or from a material having intimately molded or pierced orifices.

According to the invention, the ironing support further includes, guided in translation between two spacer elements 8 such as spacers in the form of a "C" with parallel disposed legs, a retractible platform 14 between boards 4, 6 and intended, in the pulled out position, to receive the smoothing iron.

Preferably, platform 14 has flanges 141, 142 and thus ressembles a basket 15 whose platform 14 forms the bottom.

Advantageously, this bottom is situated substantially in the median plane of the flange so as to form a double basket.

Of course, the basket 15 is made from a heat resistant material and/or includes, for receiving the iron, a stand made from a heat resistant material.

Preferably, the translation of basket 14 between these two positions one pulled out, the other pushed in is defined by stops (not shown).

In the pushed in position, the basket may advantageously serve as drawer and, for example, house accessories.

In the Figures, the basket has been shown only in its pulled out position.

Preferably, the sides of the boards are obviously joined together by rounded portions. The ironing support has dimensions such that it is easy to handle and such, more particularly, that the operator may readily turn it over so as to use it either on one side or on the other as ironing support depending on the shape of board required for the article ironed.

Advantageously, the main board will be very wide and will in particular have a width at least equal to half its length.

Purely by way of indication, for domestic use, good results have been obtained with a support whose boards are each inscribed within a rectangle 500 mm×900 mm and in which the distance between the ironing surfaces is close to 120 mm.

More modest dimensions will be provided when the ironing board has another use, for example, for ironing during travelling or for use as a toy.

Advantageously, the support may be made from wood or particle board but any other material such as metal or plastic material may be suitable provided that it withstands the heating stresses due to the smoothing iron.

For storing the board, it may be provided with suspension means such as rings.

In a variant of construction, in order to reinforce the stability not only of the main board but also of the largest accessory board, under the free end of this latter is provided an additional spacer element (not shown).

This additional element is then collapsably mounted so, during use of the large accessory board, to free if need be the passage of the clothng to be fitted on the free end.

The whole of the support may be mobile about a hinged shaft making it easier to turn it over.

Said shaft is then associated with the support such as a wall.

The main board may obviously in this case serve as an additional table.

I claim:

1. An ironing support (1) including two parallel ironing surfaces (2, 3) formed of boards (4, 5, 6) connected together by spacer elements (7, 8) of small height (H), and wherein one (2) of the ironing surfaces is formed by a single main board (4), the other (3) of the ironing surfaces is formed by two separate accessory boards (5, 6) overhanging a surface of the main board (4) opposite said one ironing surface, and the spacer elements (7, 8) connecting the accessory boards (5, 6) respectively to the main board (4) at opposite ends thereof and such that each accessory board has a free part (21, 22) extending toward the other accessory board.

2. A support according to claim 1 wherein the main board has a substantially rectangular shape and the spacer elements (7,8) are disposed at the periphery of the main board.

3. A support according to claim 1 or 2 wherein, in projection over the plane of the main board, the accessory boards (5,6) are within boundaries of the main board.

4. A support according to claim 1 or 2, wherein, in projection over the main board, the accessory boards mate with boundaries of the main board through at least two of their edges and thus are in the form of an imaginary rectangle (11) split into two parts (5,6) separated from each other by a space (12) allowing engagement of the clothes to be ironed (10) on the free part of the accessory boards.

5. A support according to claim 4, wherein a largest accessory board of said accessory boards has an edge (126) contiguous with the space (12) and which extends substantially along the diagonal of the imaginary rectangle (11), and said contiguous edge (126) joins a longitudinal side of the imaginary rectangle thereof so as to confer on the large accessory board a right angled trapezium shape providing on a boundary of the large accessory board an obtuse angle (A) suitable for ironing certain clothes (10).

6. A support according to any one of the claims 1 or 2, wherein the accessory boards have substantially shapes of right angled triangles whose hypotenuses are facing each other.

7. A support according to any one of claims 1 or 2, further comprising, guided in translation between two of said spacer elements (8), a retractable platform (14) between two of said boards (4, 5) and operable in a pulled out position, to receive an iron.

8. A support according to claim 7 wherein the platform (14) includes flanges (141, 142) to form a basket (15).

9. A support according to claim 8, wherein the platform has a bottom which is substantially situated in the median plane of the flanges so as to form a double basket.

* * * * *